US010948230B2

(12) United States Patent
Weiss et al.

(10) Patent No.: US 10,948,230 B2
(45) Date of Patent: Mar. 16, 2021

(54) REFRIGERATION APPLIANCE HAVING A DIVIDED STORAGE SPACE

(71) Applicant: BSH HAUSGERAETE GMBH, Munich (DE)

(72) Inventors: Claudia Weiss, Neu-Ulm (DE); Marcus Wehlauch, Nattheim (DE); Felix Wiedenmann, Heidenheim (DE)

(73) Assignee: BSH Hausgeraete GmbH, Munich (DE)

( * ) Notice: Subject to any disclaimer, the term of this patent is extended or adjusted under 35 U.S.C. 154(b) by 253 days.

(21) Appl. No.: 15/772,150

(22) PCT Filed: Oct. 11, 2016

(86) PCT No.: PCT/EP2016/074338
§ 371 (c)(1),
(2) Date: Apr. 30, 2018

(87) PCT Pub. No.: WO2017/076585
PCT Pub. Date: May 11, 2017

(65) Prior Publication Data

US 2018/0320955 A1 Nov. 8, 2018

(30) Foreign Application Priority Data

Nov. 2, 2015 (DE) ..... 102015221440.0

(51) Int. Cl.
*F25D 23/06* (2006.01)
*F25D 25/00* (2006.01)
(Continued)

(52) U.S. Cl.
CPC ..... *F25D 25/005* (2013.01); *F25D 11/02* (2013.01); *F25D 17/042* (2013.01);
(Continued)

(58) Field of Classification Search
CPC ..... F25D 17/06; F25D 17/04; F25D 17/065; F25D 17/045; F25D 11/02; F25D 17/042;
(Continued)

(56) References Cited

U.S. PATENT DOCUMENTS 6,347,530 B1 2/2002 Kim
6,694,761 B2 2/2004 Cho et al.
(Continued)

FOREIGN PATENT DOCUMENTS

AU 2012216426 A1 6/2013
CN 1273353 A 11/2000
(Continued)

*Primary Examiner* — Vivek K Shirsat
*Assistant Examiner* — Ko-Wei Lin
(74) *Attorney, Agent, or Firm* — Laurence A. Greenberg; Werner H. Stemer; Ralph E. Locher

(57) ABSTRACT

A refrigeration appliance, particularly a domestic refrigeration appliance, has a storage space surrounded by a thermally-insulating housing. The storage space is divided by at least one horizontal panel into an upper part and a lower part. One of the parts is divided by at least one vertical wall into two adjacent compartments. An air channel for exchanging air between an evaporator chamber and at least one first compartment extends in the vertical wall.

13 Claims, 2 Drawing Sheets

(51) Int. Cl.

| | |
|---|---|
| ***F25D 17/06*** | (2006.01) |
| ***F25D 11/02*** | (2006.01) |
| ***F25D 17/04*** | (2006.01) |
| ***F25D 25/02*** | (2006.01) |
| ***F25D 23/08*** | (2006.01) |
| *F25D 25/04* | (2006.01) |

(52) U.S. Cl.
CPC ..... *F25D 17/045* (2013.01); *F25D 17/06* (2013.01); *F25D 23/069* (2013.01); *F25D 23/08* (2013.01); *F25D 25/025* (2013.01); *F25D 23/067* (2013.01); *F25D 25/04* (2013.01); *F25D 2317/061* (2013.01); *F25D 2317/0664* (2013.01); *F25D 2400/16* (2013.01); *F25D 2500/02* (2013.01)

(58) Field of Classification Search
CPC .. F25D 17/062; F25D 17/067; F25D 2317/06; F25D 2317/063; F25D 2317/066; F25D 2317/0664; F25D 2317/0665; F25D 2317/0666; F25D 2317/0667
USPC ..... 454/173, 183; 62/441, 447
See application file for complete search history.

(56) References Cited

U.S. PATENT DOCUMENTS

| | | | | |
|---|---|---|---|---|
| 2003/0024254 | A1* | 2/2003 | Yoshida | F25D 17/042 62/78 |
| 2007/0289321 | A1* | 12/2007 | Kang | F25D 11/022 62/186 |
| 2012/0011879 | A1* | 1/2012 | Gu | F25D 23/069 62/408 |
| 2012/0023997 | A1* | 2/2012 | Jung | F25C 5/22 62/340 |

FOREIGN PATENT DOCUMENTS

| | | | | |
|---|---|---|---|---|
| CN | 1470830 | A | | 1/2004 |
| CN | 101238338 | A | | 8/2008 |
| CN | 101603762 | A | | 12/2009 |
| CN | 102494460 | A | | 6/2012 |
| CN | 102914118 | A | | 2/2013 |
| DE | 8710911 | U1 | | 9/1987 |
| EP | 2752632 | A2 | | 7/2014 |
| GB | 2197060 | A | | 5/1988 |
| JP | 2004003710 | A | * | 1/2004 |
| JP | 2013113451 | A | | 6/2013 |
| KR | 20090012228 | U | | 12/2009 |
| WO | 2007015318 | A1 | | 2/2007 |
| WO | WO2007015318 | | * | 2/2007 |

* cited by examiner

REFRIGERATION APPLIANCE HAVING A DIVIDED STORAGE SPACE

BACKGROUND OF THE INVENTION

Field of the Invention

The present invention relates to a refrigeration appliance, particularly a domestic refrigeration appliance, comprising a storage space surrounded by a thermally-insulating housing and divided by at least one horizontal panel into an upper part and a lower part. If the cooling power of an evaporator is distributed in an appropriate manner to the two parts, these parts may be operated at different temperatures, namely as a normal refrigeration compartment and as a chiller compartment, and the possibilities for the use of the refrigeration appliance are thus increased.

The broader and deeper the housing of a refrigeration appliance, the more difficult it is, in particular in the flatter of the two parts of the storage space, to achieve a sufficiently uniform temperature distribution. If cold air is only supplied to one side, typically from the rear wall of the housing, then between this rear wall and the opposing side a temperature difference of several ° C. may be easily formed.

Refrigeration appliances, in which a cold air channel is guided inside the horizontal panel and air outlet openings are distributed on a lower face of the panel in the depth direction, are known. Whilst the temperature difference between the warmest and the coldest point of the part of the storage space located below the panel may be reduced as a result, considerable useful volume of the storage space is lost to the cold air channel, since in order to be able to equalize the temperature effectively the cold air channel should not be too flat and even if it does not extend over the entire width of the panel volumes to the side of the cold air channel may only be used with difficulty. A drawback with such a solution is also that the panel has to be produced in each case so as to be appropriate for the housing dimensions and, therefore, different variants of the panel are required for different models of refrigeration appliance, in each case the variants of the panel only being produced in small quantities and being relatively expensive due to the complicated construction.

SUMMARY OF THE INVENTION

It is the object of the invention to specify a refrigeration appliance comprising a storage space which is divided by at least one horizontal panel into an upper part and a lower part, wherein the volume of the storage space is able to be used efficiently whilst undesirable temperature differences inside the different parts of the storage space may be effectively minimized.

The object is achieved by a refrigeration appliance, particularly a domestic refrigeration appliance, wherein a storage space surrounded by a thermally-insulating housing is divided by at least one horizontal panel into an upper part and a lower part, one of the parts being divided by at least one vertical wall into two adjacent compartments and an air channel for exchanging air between an evaporator chamber and at least one first compartment extends in said vertical wall. Since the extent of the vertical wall in the vertical direction will generally be considerably smaller than the extent of the panel in the horizontal direction, an air channel with given cross-sectional dimensions may be accommodated in the vertical wall in a manner which is considerably more space-saving. Moreover, the same model of vertical wall may be used in refrigeration appliances of any housing width and, therefore, produced in larger quantities than the specific horizontal panel respectively for a given housing width.

In order to minimize the temperature gradients in a compartment defined by the horizontal wall, air through-openings may be distributed on a flank of the vertical wall facing this compartment in the depth direction.

Preferably, at least one air through-opening is formed on each flank of the vertical wall in order to cool the compartments on both sides of the wall.

A transition between the air channel of the vertical wall and an air channel extending in a rear wall of the housing is preferably provided on a rear edge of the vertical wall facing the rear wall.

Since the flow of heat to the storage space is at its greatest in a front part of the housing, in particular on a seal between the door and the body of the housing, in order to minimize the temperature gradient the air through-openings may be substantially arranged in a front half of the vertical wall.

One edge of the vertical wall may bear against the panel and an opposing edge of the vertical wall may bear against a horizontal wall of the housing, in order to minimize an exchange of air between the compartments on both sides of the wall. This is expedient, in particular, when different operating temperatures are intended to be maintained, not only between the upper and the lower part of the storage space but also between the compartments on both sides of the vertical wall.

Typically, at least one of the compartments may contain a drawer. Thus the compartment may be used comfortably, even with the restricted height immediately in front of the rear wall.

If a second air channel is provided in the partition wall for exchanging air between the evaporator chamber and the second compartment, this makes it easier to maintain different operating temperatures in the two compartments by selectively subjecting the compartments to cold air.

A valve for selectively subjecting the first or the second air channel to an air flow may be accommodated in a wall of the housing, typically in the rear wall adjacent to the transition.

Preferably, the air channels are offset vertically relative to one another in the vertical wall. Thus in spite of the vertically and longitudinally extended cross section of the wall, a compact cross section which is more advantageous in terms of flow may be provided for each air channel.

In particular, if the two compartments are intended to be operated at different temperatures, or at least the possibility thereof is intended to be present, then it is expedient if the vertical wall, preferably also the horizontal panel, contains an insulating material layer.

The insulating material layer of the vertical wall may expediently comprise two insulating bodies, each insulating body forming one side of the at least one air channel.

Typically, the insulating bodies are molded bodies made of a porous material, such as expanded polystyrene.

For cost-effective production, it is advantageous if the insulating bodies are of the same shape. In particular, the insulating bodies may have in each case longitudinally extended recesses on the flanks in contact with one another, said recesses mutually complementing one another to form an air channel.

An outer skin of the vertical wall may comprise two shell parts fastened together along the edges thereof, each shell part forming one of the two flanks of the vertical wall. Each shell part may receive one of the insulating bodies in order to protect said insulating body from becoming soiled and damaged.

In order to connect the shell parts, one of the shell parts, preferably together with the insulating body received therein, may define a groove and the other shell part may comprise a tongue engaging in the groove.

BRIEF DESCRIPTION OF THE SEVERAL VIEWS OF THE DRAWING

Further features and advantages of the invention are disclosed in the following description of exemplary embodiments with reference to the accompanying drawings, in which.

DESCRIPTION OF THE INVENTION

Figure 1:
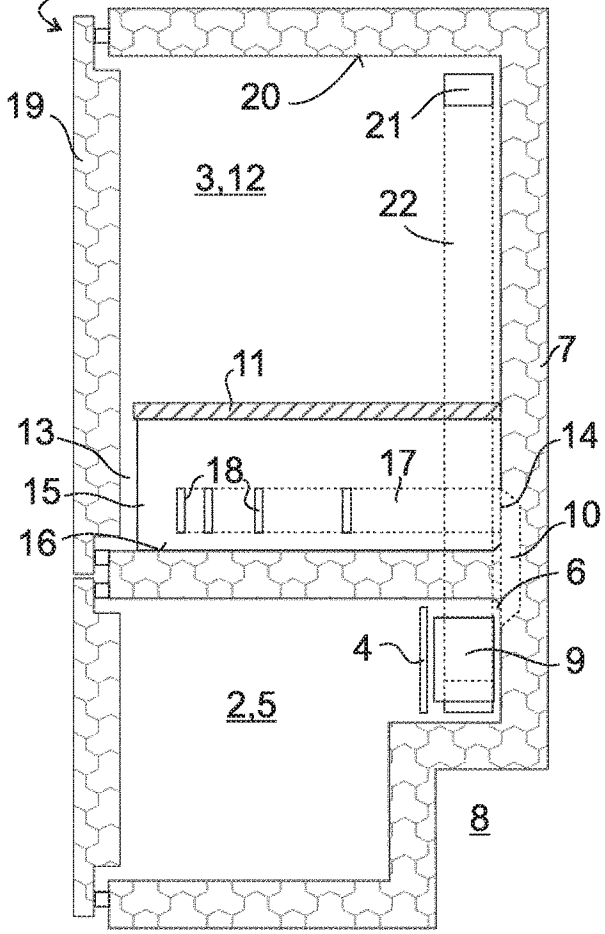
FIG. 1 shows a schematic section through a refrigeration appliance according to a first embodiment of the invention.

The domestic refrigeration appliance shown in section in FIG. 1 is a combi-appliance, two internal chambers 2, 3 being formed in the thermally-insulating housing 1 thereof. The lower internal chamber 2 is divided by a partition wall 4 into a freezer compartment 5 and an evaporator chamber 6 which is arranged between the freezer compartment 5 and a rear wall 7 of the housing 1 above a machine space niche 8. The evaporator chamber 6 contains an evaporator 9 and a fan, not shown in the Fig., which blows air cooled on the evaporator 9 into the freezer compartment 5 and via a channel 10 extending in the rear wall 7 into the upper internal chamber 3.

The upper internal chamber 3 is divided by a removable horizontal panel 11 into an upper part 12 and a lower part 13. The panel 11 is supported on the side walls of the housing 1 and extends over substantially the entire depth of the internal chamber 3, from the rear wall 7 to just before the inner face of a door 19.

In the view of FIG. 1 the channel 10 terminates at an outlet 14 below the panel 11; however the channel could also be extended upwardly beyond the panel 11 and comprise a plurality of outlets below and above the panel 11.

The lower part 13 in the width direction of the housing 1 is divided by a vertical wall 15—viewed from the front—into a right-hand and left-hand compartment. The edges of the vertical wall 15 bear closely against the panel 11, a base 16 of the interior 3 and the rear wall 7; a channel 17 recessed in the interior of the vertical wall 15—indicated in FIG. 1 by dotted lines—adjoins the outlet 14. In the right-hand flank of the wall 15 facing the observer in FIG. 1, a plurality of air through-openings 18 are formed via which the channel 17 discharges into the right-hand compartment.

The cold air flowing into the right-hand compartment via the channel 17 flows between the front edge of the panel 11 and the door 19 into the upper part 12 of the internal chamber 3, finally returning to the evaporator chamber 6 via an air through-opening 21 adjacent to the top wall 20 of the internal chamber 3 and a channel 22 extending in a side wall of the housing 1.

In the construction shown in FIG. 1, the upper part 12 is always warmer than the lower part 13, since cold air is only able to reach the upper part 12 via the lower part; if the upper region 12 is intended to be temperature-controlled as a normal refrigeration compartment, the lower region 13 is suitable as a chiller compartment. In an alternative embodiment in which the channel 10 also has outlets above the panel 11, both parts 12, 13 may also be temperature-controlled to be approximately the same.

The channel 17 in the vertical wall 15 may comprise air through-openings 18 on both flanks of the wall 15, in order to cool the left-hand and right-hand compartment of the lower part 13. By means of a preferred embodiment and as shown in FIGS. 2 and 3, above the channel 17 and parallel thereto a second channel 23 extends through the wall 15, said second channel being supplied via a second outlet 14 of the channel 10, and each channel 17, 23 has air through-openings 18 only on one of the two flanks of the wall 15.

Figure 2:
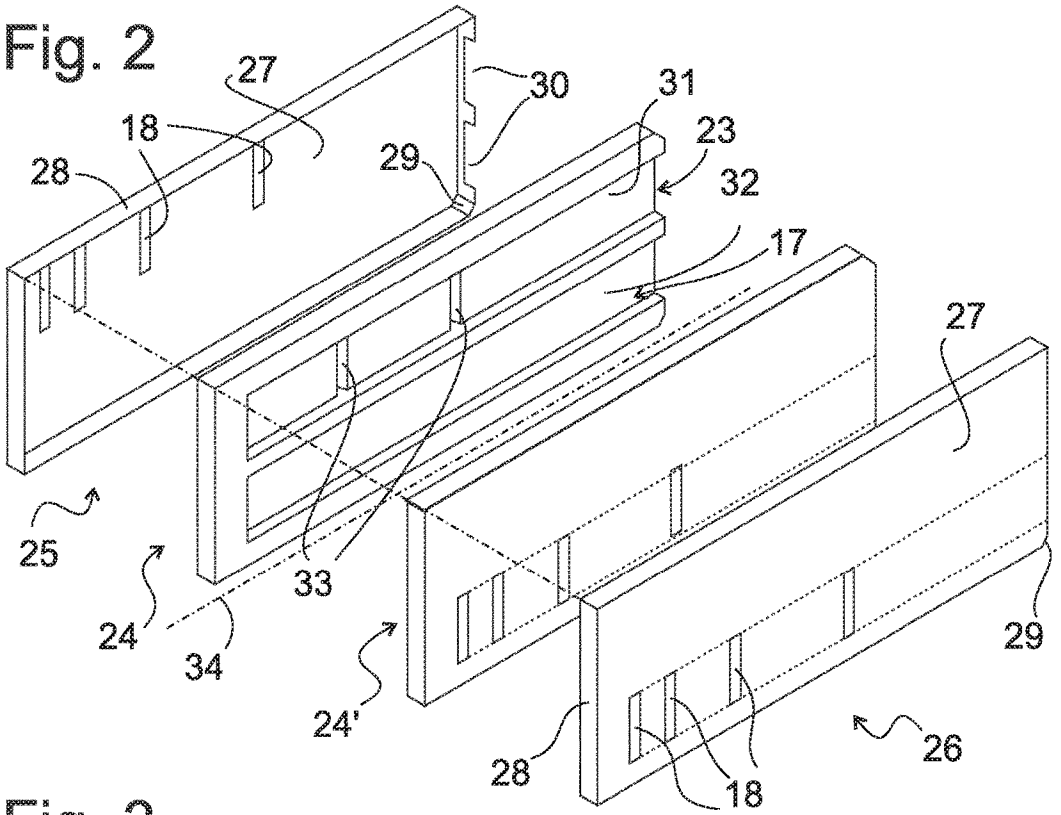
FIG. 2 shows an exploded perspective view of components of a vertical wall of the refrigeration appliance of FIG. 1.
Figure 3:
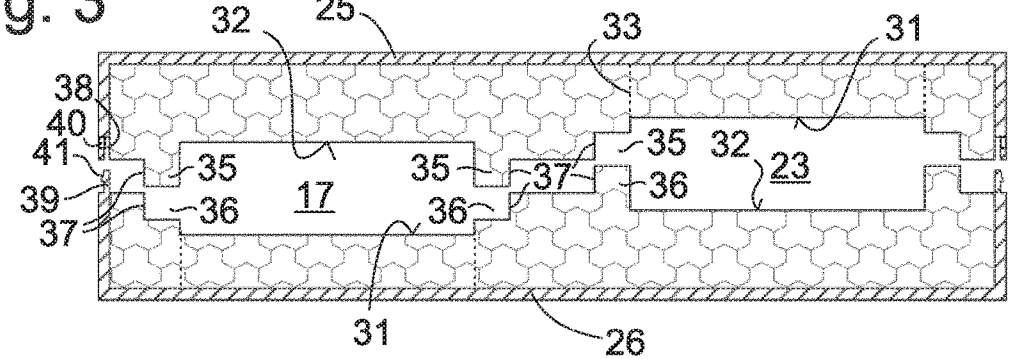
FIG. 3 shows a cross section through the vertical wall.

As is clear in particular in FIG. 2, the wall 15 is substantially made up of four components, two identical insulating bodies 24, 24' made of thermally-insulating material such as expanded polystyrene, and two shell parts 25, 26 made of solid plastics. The shell parts 25, 26 have in each case a planar base panel 27 which in each case forms one of the flanks of the wall 15, the air through-openings 18 being cut out therefrom, surrounded by a peripheral web 28. On a lower rear corner 29, the shell parts 25, 26 are truncated or rounded off, so as to be adapted to the generally rounded transition between the rear wall 7 and the base 16 on a deep-drawn internal container, so that the lower and rear portions of the web adjacent to the corner 29 are able to bear closely against the base 16 and/or the rear wall 7. In the rear portion of the web 28, in each case two passages 30 are formed on both shell parts 25, 26, said passages being aligned with the channels 17, 23.

The insulating bodies 24, 24' in each case have the shape of flat rectangular blocks, two horizontally extending grooves 31, 32 being recessed in the main surfaces thereof facing one another. The upper groove 31 of the insulating body 24 has on its base a plurality of through-passages 33 which are aligned with the air through-openings 18 in the upper half of the shell part 25. The insulating body 24' differs from the insulating body 24 merely by its orientation; both are able to be transferred into one another by a 180° rotation about a horizontal axis 34, so that each channel 17 and/or 23 is defined in one insulating body by the groove 31 and in the other insulating body by the groove 32. Accordingly, in the insulating body 24' the groove 32 and the through-passages 33 are located in the lower half so that they are aligned with the air through-openings 18 of the shell part 26 arranged in the lower half of the base panel 27.

In a similar manner to the wall 15, the panel 11 may comprise a thermally-insulating panel received in a protective housing in order to insulate the upper and lower part 12, 13 of the internal chamber 3 from one another.

FIG. 3 shows by means of a cross section various further optional structural details of the wall 15. One of these details is the depth of the grooves 31, 32. The groove 31 is deeper than the groove 32 so that the channels 17, 23 in each case are separated from the flank of the wall 15 into which they lead by a thinner layer of insulating material than from the opposing flank.

Moreover, in each case one of the grooves, in this case the groove 32, is bordered by a rib 35 and the respective other groove 31 is bordered by a recess 36 which is complementary to the rib 35. Since in the assembled state of the wall 15, the walls 37 of the rib 35 and the recess 36 which are parallel relative to the direction of extent are in contact with one another, the channels 17, 24 are sealed all around.

In one of the shell parts, in this case the shell part 25, the web 28 on its edge remote from the base panel, is slightly reduced in size so that it defines a peripheral groove 38 together with the insulating body 24, a tongue 39 which protrudes over the edge of the web 28 of the shell part 26 engaging therein. The edges may be provided with latching means which engage in one another, such as for example openings 40 or recesses on the shell part 25 and projections 41 on the shell part 26 engaging in the openings 40, in order to connect together the shell parts 25, 26 in the assembled state in a positive and fixed manner.

Figure 4:
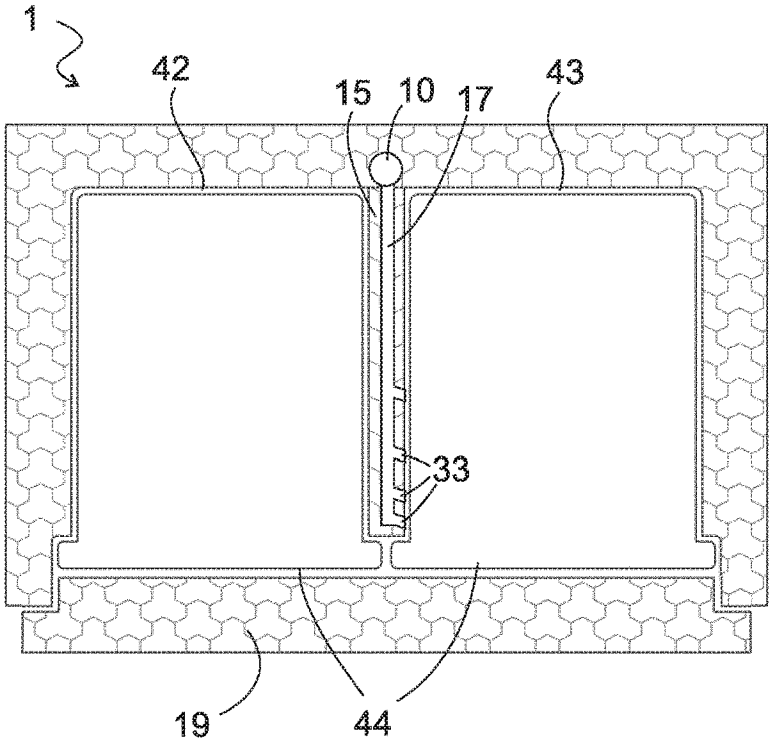
FIG. 4 shows a horizontal section through the body of the refrigeration appliance of FIG. 1.

FIG. 4 shows a horizontal section through the refrigeration appliance of FIG. 1 level with the lower channel 17. The two compartments to the left and right of the vertical wall 15 in this case are denoted by 42, 43 and in each case contain a drawer 44. In the rear wall the channel 10 may be seen in section, the channels 17, 23 being supplied thereby with cold air from the evaporator.

In the simplest case, the channel 10 is free of adjustable elements which control the distribution of the cold air. Thus due to the symmetrical construction of the wall 15 the same amount of cold air is allotted to each compartment 42, 43 and when the compartments 42, 43 are of the same size the same operating temperature is set in both compartments. This operating temperature is not adjustable independently of that of the upper part 12.

Figure 5:
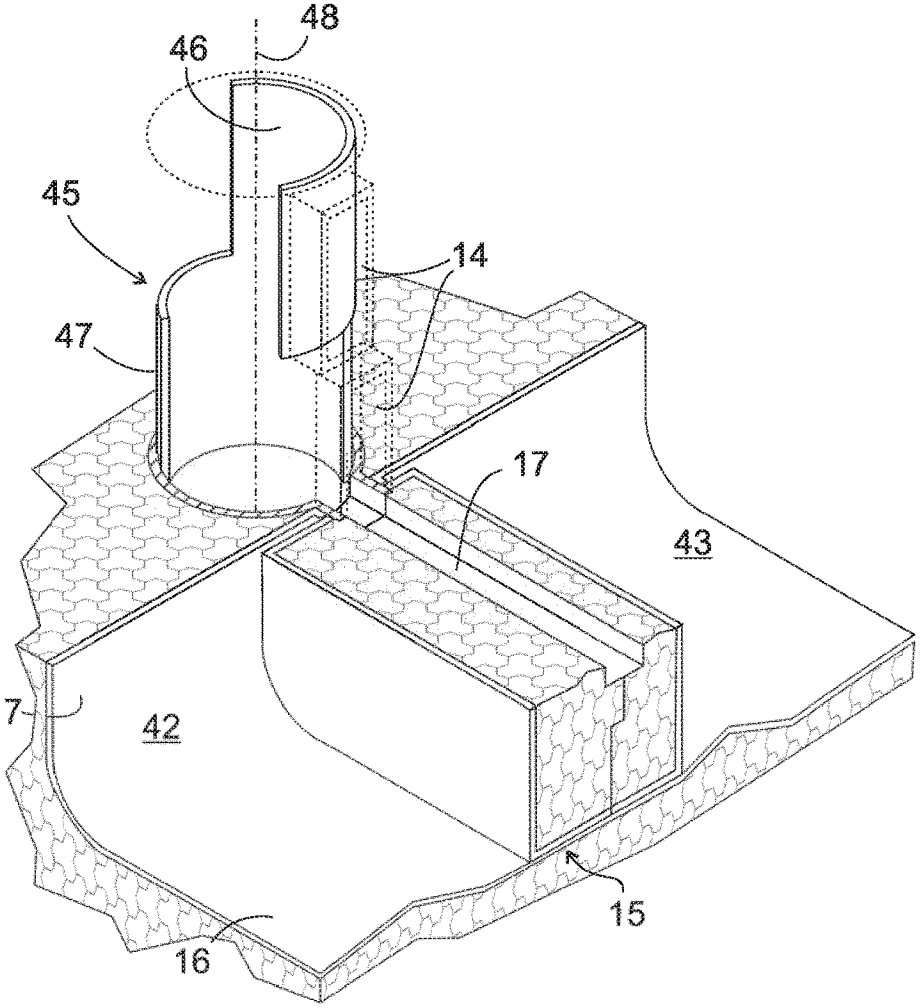
FIG. 5 shows a detail of the refrigeration appliance in an enlarged perspective view.

FIG. 5 shows the channels 10, 17 according to a further developed embodiment, partially in perspective and partially in section, wherein an element 45 controlling the distribution of cold air is arranged in the channel 10. The channel 10 in this case is cylindrical and the element 45 controlling the distribution of cold air comprises two portions 46, 47 which are circular arc-shaped in cross section and which are rotatable about an axis 48 which is concentric to the channel 10. The lower portion 46 is shown in FIG. 5 in a position in which the lower air outlet 14 is open toward the channel 17—shown cut away. The upper outlet 14 to the channel 23—not shown—is shown in dotted lines in FIG. 5; said upper outlet is blocked by the portion 47. In the position shown, therefore, only the compartment 43 to the right of the wall 15 is cooled. By a rotation by ca. 90° counterclockwise, the upper air outlet 14 is also opened, so that the channel 23 is also supplied and both compartments 42, 43 are cooled at the same time. A further rotation by 90° closes the lower outlet 14 and after a further 90° rotation both outlets 14 are closed. Since each compartment 42, 43 may be specifically cooled separately, therefore, different storage temperatures may be set in both compartments 42, 43 and optionally controlled by temperature sensors arranged on the compartments 42, 43.

If the channel 10 extends upwardly beyond the panel 11 to the outlets in the upper part 12, then it is possible in this latter position to cool solely the upper part 12 and thus to control the temperature both of this upper part and the compartments 42, 43 independently of one another.

In production, the wall 15 with the two channels 17, 23 is not more costly than the variant mentioned in the introduction with a single channel which is open toward both compartments 42, 43, but has the advantage that it may be used both in a refrigeration appliance without a controlling element 45 and in an appliance with such an element.

The length of the edge of the wall 15 is predetermined by the depth of the housing 1 and the distance of the panel 11 from the base 16. Therefore the same wall 15 may be used in different models of refrigeration appliances with different housing widths, including those in which the upper internal chamber is not closed by a single door 19 but by two doors articulated on the opposing side walls of the housing 1.

LIST OF REFERENCE NUMERALS

1 Housing
2 Internal chamber
3 Internal chamber
4 Intermediate wall
5 Freezer compartment
6 Evaporator chamber
7 Rear wall
8 Machine space niche
9 Evaporator
10 Channel
11 Panel
12 Upper part
13 Lower part
14 Outlet
15 Wall
16 Base
17 Channel
18 Air through-opening
19 Door
20 Top wall
21 Air through-opening
22 Channel
23 Channel
24 Insulating body
25 Shell part
26 Shell part
27 Base panel
28 Web
29 Corner
30 Passage
31 Groove
32 Groove
33 Through-passage
34 Axis
35 Rib
36 Recess
37 Wall
38 Groove
39 Tongue
40 Opening
41 Projection
42 Compartment
43 Compartment
44 Drawer
45 Controlling element
46 Portion
47 Portion
48 Axis

The invention claimed is:

1. A refrigeration appliance, comprising:

a thermally-insulating housing enclosing a storage space;

at least one horizontal panel dividing said storage space into an upper part and a lower part;

a vertical wall disposed to divide one of said upper or lower parts into two adjacent compartments;

said vertical wall being formed with a first air channel having a first longitudinal extent in said vertical wall for exchanging air between an evaporator chamber and a first compartment of said two adjacent compartments, said first air channel having a first opening in a lateral side thereof opening out into said first compartment; and said vertical wall being formed with a second air channel having a second longitudinal extent in said vertical wall for exchanging air between said evaporator chamber and a second compartment of said two adjacent compartments, said second air channel having a second opening in a lateral side thereof opening out into said second compartment.

2. The refrigeration appliance according to claim 1, wherein said housing has a rear wall and wherein a passage between said first air channel of said vertical wall and a channel extending in said rear wall of said housing is formed on a rear edge of said vertical wall facing said rear wall.

3. The refrigeration appliance according to claim 1, wherein said first and second openings are substantially arranged in a front half of said vertical wall.

4. The refrigeration appliance according to claim 1, wherein an edge of said vertical wall bears against said at least one horizontal panel and an opposing edge of said vertical wall bears against a horizontal wall of said housing.

5. The refrigeration appliance according to claim 1, comprising a drawer in at least one of said adjacent compartments.

6. The refrigeration appliance according to claim 1, comprising a controlling element disposed in a wall of said housing for selectively effecting an air flow in said first air channel or said second air channel.

7. The refrigeration appliance according to claim 1, wherein said first and second air channels are offset vertically to one another in said vertical wall.

8. The refrigeration appliance according to claim 1, wherein said vertical wall contains an insulating material layer.

9. The refrigeration appliance according to claim 8, wherein said insulating material layer comprises two insulating bodies, each forming one side of said at least one air channel.

10. The refrigeration appliance according to claim 9, wherein said insulating bodies are of the same shape.

11. The refrigeration appliance according to claim 1, wherein an outer skin of said vertical wall comprises two shell parts, each of said two shell parts having edges, and said shell parts being fastened together along said edges, each shell part forming one of two flanks of said vertical wall.

12. The refrigeration appliance according to claim 11, wherein one of said shell parts is formed with a groove and the other said shell part is formed with a tongue engaging in said groove.

13. The refrigeration appliance according to claim 1, configured as a domestic refrigeration appliance.

* * * * *